US010173187B2

(12) United States Patent
Højbjerre et al.

(10) Patent No.: US 10,173,187 B2
(45) Date of Patent: Jan. 8, 2019

(54) PROCESSING MACHINE, SUCH AS A KNEADING OR MIXING MACHINE

(71) Applicant: A/S Wodschow & Co., Brøndby (DK)

(72) Inventors: Morten Højbjerre, Brøndby (DK); Jesper Holmegaard Olsen, Brøndby (DK)

(73) Assignee: A/S Wodschow & Co., Brøndby (DK)

( * ) Notice: Subject to any disclaimer, the term of this patent is extended or adjusted under 35 U.S.C. 154(b) by 458 days.

(21) Appl. No.: 14/895,176

(22) PCT Filed: Jun. 3, 2014

(86) PCT No.: PCT/EP2014/061449
§ 371 (c)(1),
(2) Date: Dec. 1, 2015

(87) PCT Pub. No.: WO2014/198584
PCT Pub. Date: Dec. 18, 2014

(65) Prior Publication Data

US 2016/0101394 A1 Apr. 14, 2016

(30) Foreign Application Priority Data

Jun. 11, 2013 (DK) ..... 2013 70315

(51) Int. Cl.
*B01F 13/00* (2006.01)
*B01F 13/04* (2006.01)
(Continued)

(52) U.S. Cl.
CPC ..... *B01F 13/047* (2013.01); *B01F 7/16* (2013.01); *B01F 7/1605* (2013.01); *B01F 15/00967* (2013.01)

(58) Field of Classification Search
CPC .. B01F 13/0818; B01F 15/00967; B01F 7/16; B01F 13/047; B01F 7/1605
(Continued)

(56) References Cited

U.S. PATENT DOCUMENTS 2,491,957 A * 12/1949 Dilley ..... F16P 1/02 144/251.1
3,159,196 A 12/1964 Engi
(Continued)

FOREIGN PATENT DOCUMENTS

| | | | |
|---|---|---|---|
| EP | 1 862 624 | A2 | 12/2007 |
| FR | 2 740 064 | A1 | 4/1997 |
| WO | WO 02/051293 | A1 | 7/2002 |

OTHER PUBLICATIONS

International Search Report completed Sep. 4, 2014 for International Application No. PCT/EP2014/061449.
(Continued)

*Primary Examiner* — Anshu Bhatia
(74) *Attorney, Agent, or Firm* — Brinks Gilson & Lione

(57) ABSTRACT

The processing machine (1) is adapted to carry a processing tool driven by a motor and includes a safety shield (4) adapted to at least partly shield the processing tool in relation to a user. The safety shield (4) is arranged displaceably away from its shielding position and a magnetically activatable safety arrangement (14) includes a safety switch (15) being operable between a passive state in which the motor (2) is allowed to operate and an activated state in which the motor is prevented from operation. The safety switch (15) is arranged to switch from its passive state to its activated state when the safety shield (4) is displaced away from its shielding position. At least one magnet (16) is arranged to hold said displaceable safety shield (4) in its
(Continued)

shielding position and at the same time hold the safety switch (15) in its passive state.

27 Claims, 11 Drawing Sheets

(51) Int. Cl.
*B01F 7/16* (2006.01)
*B01F 15/00* (2006.01)

(58) Field of Classification Search
USPC ..... 366/347
See application file for complete search history.

(56) References Cited

U.S. PATENT DOCUMENTS

| | | | | |
|---|---|---|---|---|
| 4,520,703 | A | 6/1985 | Speckhart | |
| 7,354,192 | B2 | 4/2008 | Jejcic | |
| 2003/0011147 | A1 | 1/2003 | Ochiai et al. | |
| 2006/0227654 | A1* | 10/2006 | Blackburn ..... | A47J 43/0705 366/206 |
| 2009/0190438 | A1 | 7/2009 | Short et al. | |

OTHER PUBLICATIONS

International Preliminary Report on Patentability completed May 7, 2015 for International Application No. PCT/EP2014/061449.

* cited by examiner

PROCESSING MACHINE, SUCH AS A KNEADING OR MIXING MACHINE

This application claims the benefit under 35 U.S.C. § 371 of International Application No. PCT/EP2014/061449, filed Jun. 3, 2014, which claims the benefit of Danish Application No. PA 2013 70315, filed Jun. 11, 2013, which are incorporated by reference herein in their entirety.

The present invention relates to a processing machine, such as a kneading or mixing machine, adapted to carry a processing tool, such as a kneading or mixing tool, driven by a motor and including a safety shield adapted to at least partly shield the processing tool in relation to a user when the safety shield is in a shielding position in relation to the processing tool, the safety shield being arranged displaceably away from its shielding position in order to allow access to the processing tool, and a magnetically activatable safety arrangement including a safety switch being operable between a passive state in which the motor is allowed to operate and an activated state in which the motor is prevented from operation, said safety switch being arranged to switch from its passive state to its activated state when the safety shield is displaced away from its shielding position.

U.S. Pat. No. 7,354,192 B2 discloses a blender for producing ice cream. A safety grille is fixed removably to a cover of the blender in that the cover has a number of vertically projecting pins that may engage firmly into corresponding holes in a crosspiece of the safety grille. At least one permanent magnet fixed stably to the crosspiece of the safety grille may interact with a corresponding magnetic presence sensor located inside a box-shaped casing of the blender in order to prevent operation of the blender if the safety grille is not correctly in place. However, in the case of failure of the magnetic presence sensor, the user would not be warned and the blender would possibly be able to operate although the safety grille had been removed.

WO 02/051293 A1 discloses a food processor including a cover. A safety switch is adapted to prevent operation of the food processor when the cover has been removed. The safety switch may operate by means of magnetism. However, in the case of failure of the safety switch, the user would not be warned and the food processor would possibly be able to operate although the cover had been removed.

In prior art devices such as those described above including a conventional magnetic presence sensor, a relatively little magnetic force is required for activation of the sensor. Therefore, as explained, in the case of failure of the internal components of such a magnetic presence sensor, the user will not notice. As a consequence, in professional processing machines, such as kneading or mixing machines, a safety arrangement on the basis of such a conventional magnetic presence sensor is generally not acceptable. Therefore, such machines normally incorporate a safety mechanism based on a mechanically activated micro switch having an actuation lever arranged to be actuated when a safety shield of the machine is removed. However, such an arrangement may be complicated due to requirements that the system should be tamperproof. Accordingly, in well known devices, the safety shield mechanically activates a micro switch through a kind of mechanical labyrinth. However, this solution may be less cleaning-friendly than desired.

U.S. Pat. No. 4,520,703 discloses an electromotively driven household slicing machine for food having a cutting tool. A protective shield can be provided with permanent magnets which preferably act in conjunction with the cutting tool and serve to fasten the shield to the cutting tool.

The object of the present invention is to provide a processing machine having an improved safety arrangement.

In view of this object, at least one magnet is arranged to hold said displaceable safety shield in its shielding position and at the same time hold the safety switch in its passive state.

Thereby, as the magnetic force acts to hold the safety shield, a much larger magnetic force may be employed as compared to the prior art without influencing the handling of the safety shield negatively, and thereby the safety arrangement may also be adapted to require such larger magnetic force in order to allow operation of the motor of the machine. Fail-safe operation of the safety arrangement may thereby be ensured to a greater extent than in prior art devices.

Additionally, this solution may be more cleaning-friendly than known solutions incorporating a mechanically activated micro switch.

In an embodiment, said displaceable safety shield is adapted to be carried in its shielding position only by means of magnetic force. Indeed, this solution may be very cleaning-friendly compared to known solutions incorporating a mechanically activated micro switch.

In an embodiment, the magnetically activatable safety arrangement includes a displaceable activation element movable between a first position in which the safety switch is allowed to be in its passive state and a second position in which the safety switch is forced to its activated state, the displaceable activation element is biased towards its second position, and the at least one magnet is arranged to move the displaceable activation element from its second position to its first position upon displacement of the safety shield into its shielding position. Thereby, the magnetic force holding the displaceable safety shield in its shielding position may be acting between the displaceable safety shield and the displaceable activation element. The result is that the biasing force biasing the displaceable activation element towards its second position may be almost as great as the force required to hold the displaceable safety shield in its shielding position, whereby proper activation of the safety switch may be ensured.

In an embodiment, the displaceable activation element extends at least partially in a circumferential direction in relation to a rotational axis of the processing tool. Thereby, the displaceable activation element may interact magnetically with one or more magnets arranged on a safety shield suitably extending in said circumferential direction.

In an embodiment, the displaceable activation element has the form of a ring-formed plate element. Thereby, the displaceable activation element may suitably interact magnetically with a corresponding ring-formed contact element of a preferably tubular safety shield. Furthermore, the angular positioning of said tubular safety shield may be without importance for the magnetic holding force, as said magnetic holding force may be distributed more or less regularly over the circumference of the ring-formed plate element or of the corresponding ring-formed contact element.

In an embodiment, the ring-formed plate element is arranged tiltably about an edge of the ring-formed plate element so that an activation section of the ring-formed plate element opposed to said edge is movable between a first position and a second position. Thereby, proper activation of said activation section may be ensured by two or more magnets arranged regularly spaced in the circumferential direction of a tubular safety shield, independently of the orientation of the tubular safety shield. Thereby, mounting of such safety shield may be facilitated.

In a structurally advantageous embodiment, in the first position of the activation section, the activation section abuts a bottom wall of a housing of the processing machine, and in the second position of the activation section, the activation section abuts a stationary bracket element arranged at a distance from the bottom wall of the housing.

In a structurally advantageous embodiment, the safety switch is arranged on the stationary bracket element so that an activation arm of the safety switch may abut the activation section of the ring-formed plate element.

In a structurally advantageous embodiment, a permanent magnet is arranged on the stationary bracket element in order to bias the displaceable activation element towards its second position. Thereby, the operation may be more fail-safe than by incorporation of for instance a spring element to bias the displaceable activation element.

In an embodiment, the at least one magnet is arranged on the safety shield and is adapted to attract the displaceable activation element. Thereby, the operation of the safety arrangement may be more tamperproof, as a number of strong magnets may be required to operate the safety arrangement without positioning the safety shield in its correct position.

In an embodiment, the safety shield has a ring-formed contact element adapted to abut a stationary surface of the processing machine, said surface extending at least substantially about a rotational axis of the processing tool, and the ring-formed contact element is provided with at least two magnets spaced regularly in the circumferential direction of the ring-formed contact element. Thereby, a good protection of the user may be obtained all around the processing tool, and the safety shield may easily be placed by the user in any rotational position.

The invention will now be explained in more detail below by means of examples of embodiments with reference to the very schematic drawing, in which FIG. 1 is a perspective view of a kneading machine according to the invention;

Figure 1:
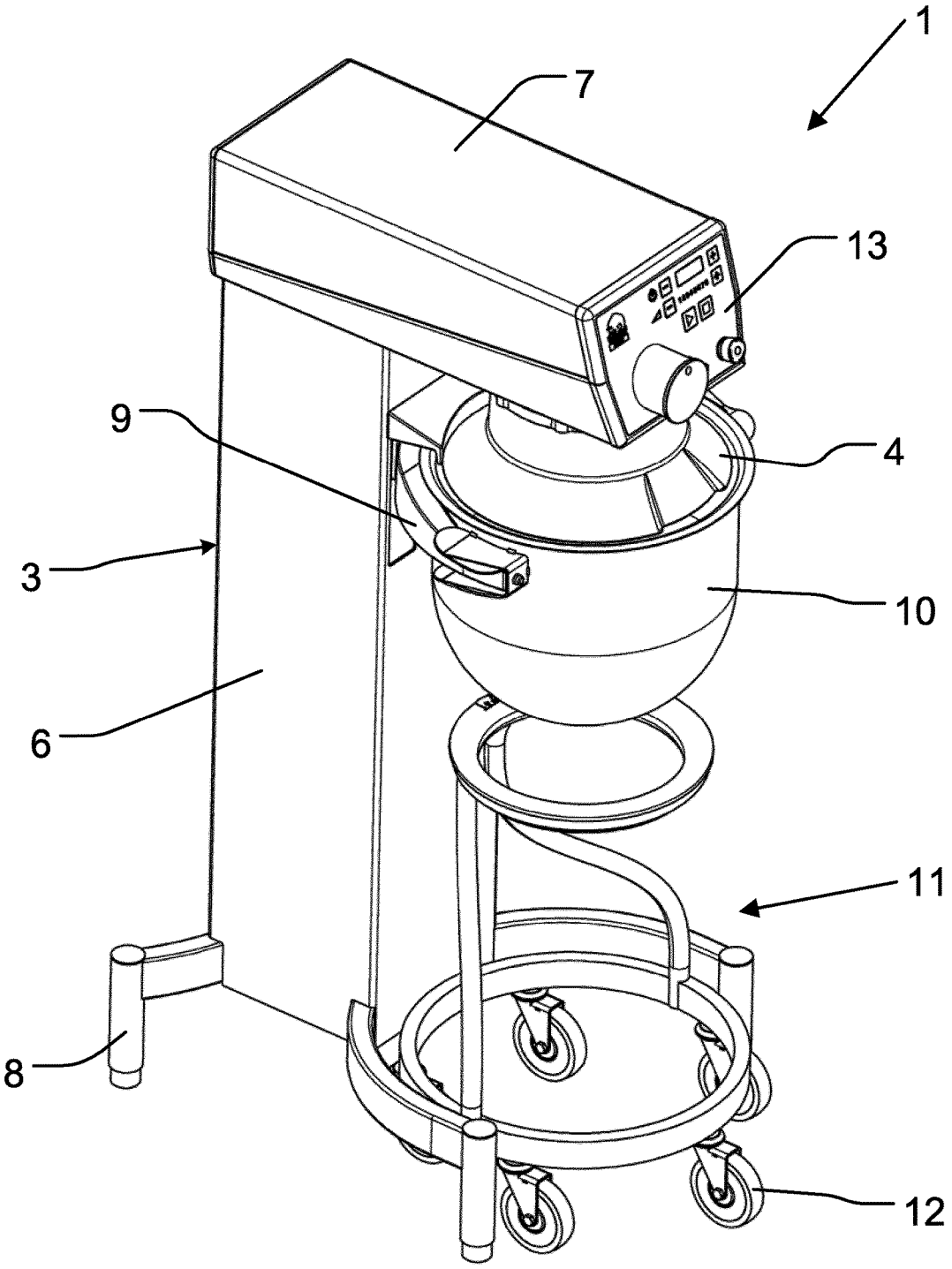
Figure 2:
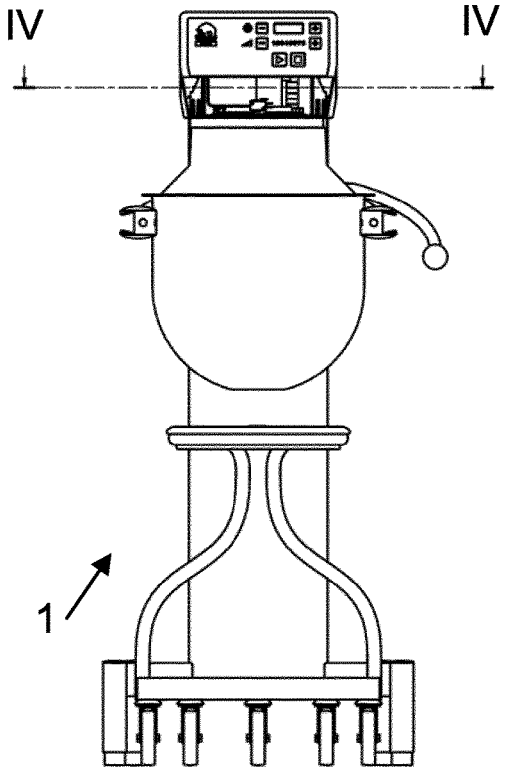
FIG. 2 is a front view of the kneading machine in FIG. 1.
Figure 3:
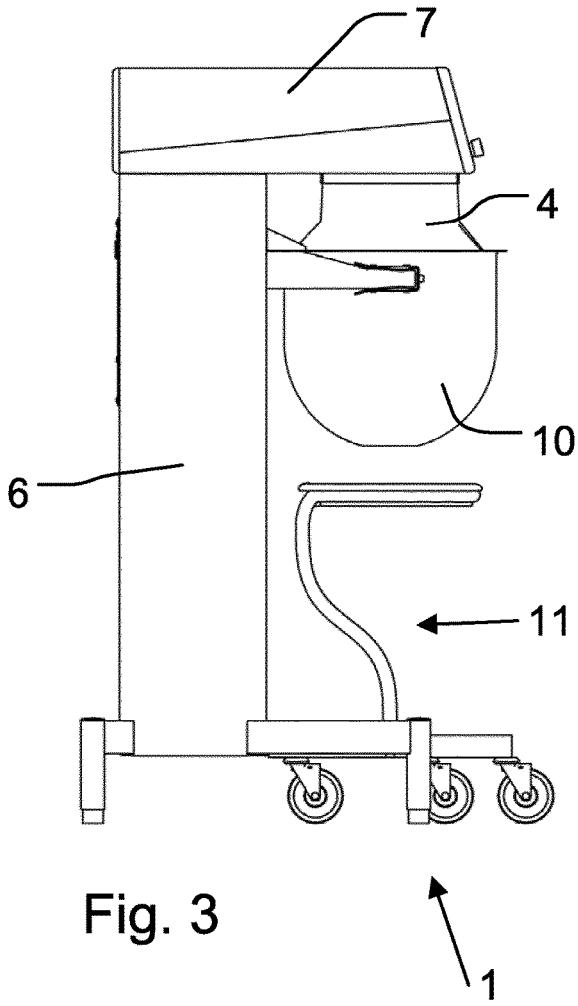
FIG. 3 is a side view of the kneading machine in FIG. 1.
Figure 4:
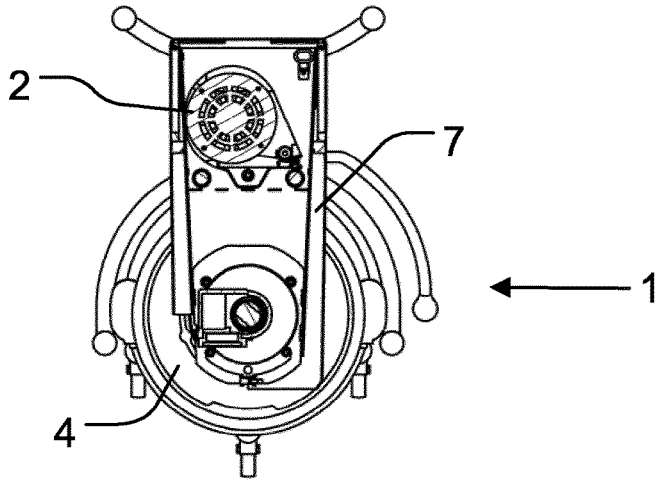
FIG. 4 is a cross section through the kneading machine along the line IV-IV in FIG. 2.
Figure 5:
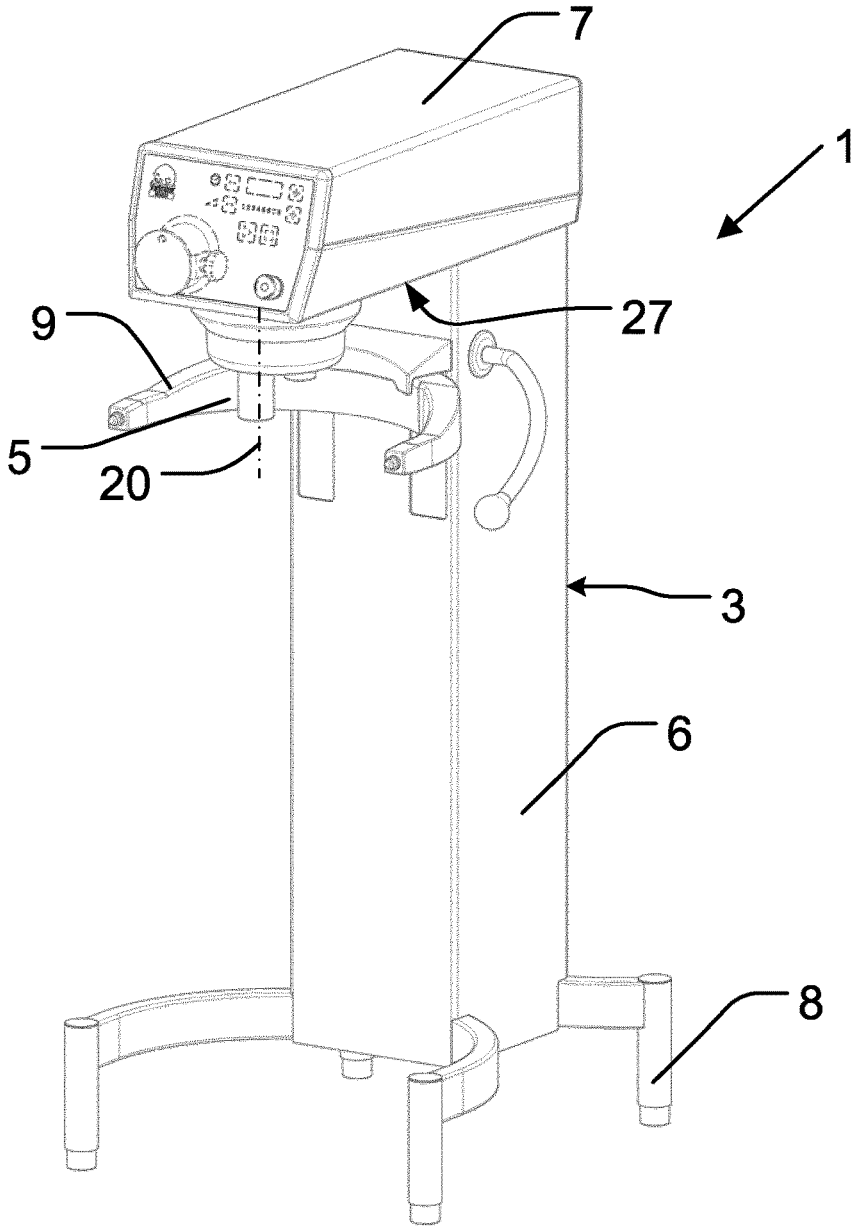
FIG. 5 is a perspective view of part of the kneading machine in FIG. 1, whereby various components have been removed.

FIG. 1 illustrates a processing machine 1 according to the invention in the form of a kneading and mixing machine, adapted to carry a not shown processing tool, such as a kneading or mixing tool, driven by a motor 2 arranged in a cabinet 3 of the processing machine 1. The processing machine 1 includes a safety shield 4 adapted to at least partly shield the not shown processing tool in relation to a user, when the safety shield 4 is in a shielding position in relation to the processing tool, as illustrated in FIGS. 1 to 4. The safety shield 4 is arranged displaceably away from its shielding position in order to allow access to the processing tool by the user, and in the embodiment illustrated, the safety shield 4 may be entirely removed from the cabinet 3 of the processing machine 1, as illustrated in FIG. 5. In FIG. 5, a coupling 5 on which the processing tool may be mounted is visible. The coupling 5 is rotatable by means of the motor 2 in a manner known per se. Although the processing machine 1 according to the invention in this description is exemplified by means of a kneading and mixing machine, it is understood by the person skilled in the art that the invention is equally applicable to other types of processing machine 1, such as for instance a household food processor, a blender, a slicing machine, a milling or drilling machine for processing any kind of material, such as wood or metal, or any kind of processing machine whereby it may be desired to shield and protect a user from a rotating or moving tool.

As illustrated in the figures, the cabinet 3 of the processing machine 1 is composed by a vertically extending column 6 standing on feet 8 up from a floor and a horizontally extending housing 7 mounted on top of the column 6 and extending forwards there from. The housing 7 includes the motor 2 as visible in section in FIG. 4, the coupling 5 as visible in FIG. 5 and a not illustrated transmission there between such as a drive shaft any other suitable transmission. The front of the housing 7 is furthermore provided with a slightly oblique control panel 13 for operation of the processing machine 1. The vertically extending column 6 is provided with vertically extending arms 9 adapted to carry a vessel 10 in which the kneading or mixing tool may be operated in a well known manner. The vertically extending arms 9 are preferably height adjustably arranged on the column 6 in order to facilitate mounting and demounting of the processing tool and furthermore in order to facilitate removal and placement of the safety shield 4 in its shielding position. Furthermore, the processing machine 1 includes a trolley 11 provided with caster wheels 12 and adapted to transport the vessel 10 to and from the processing machine.

Figure 6:
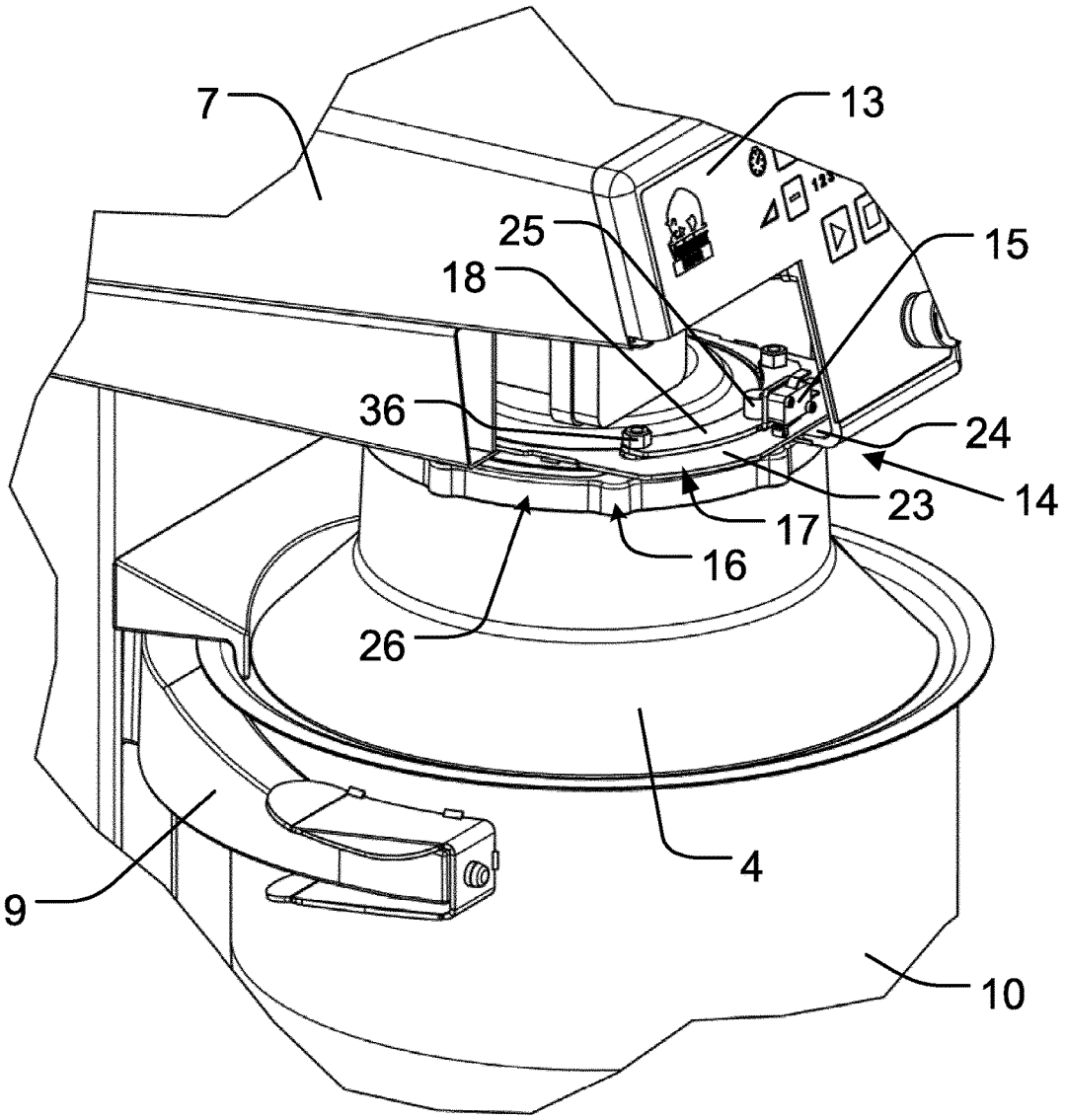
FIG. 6 is a perspective view of part of the kneading machine in FIG. 1, whereby part of a covering has been removed.
Figure 8:
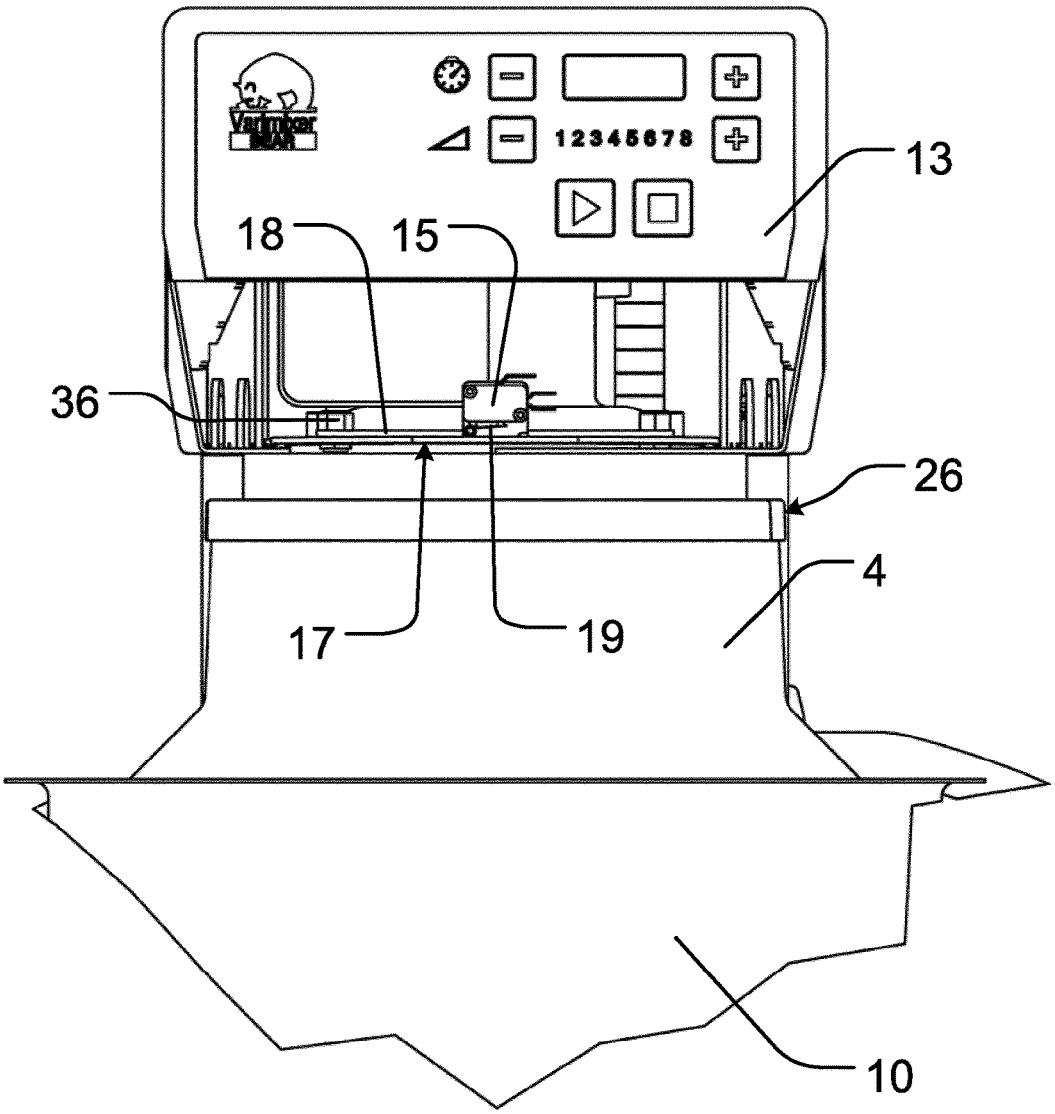
FIGS. 8 and 9 are front views of part of the kneading machine in FIG. 1; whereby part of a covering has been removed, illustrating different modes of operation, respectively.
Figure 9:
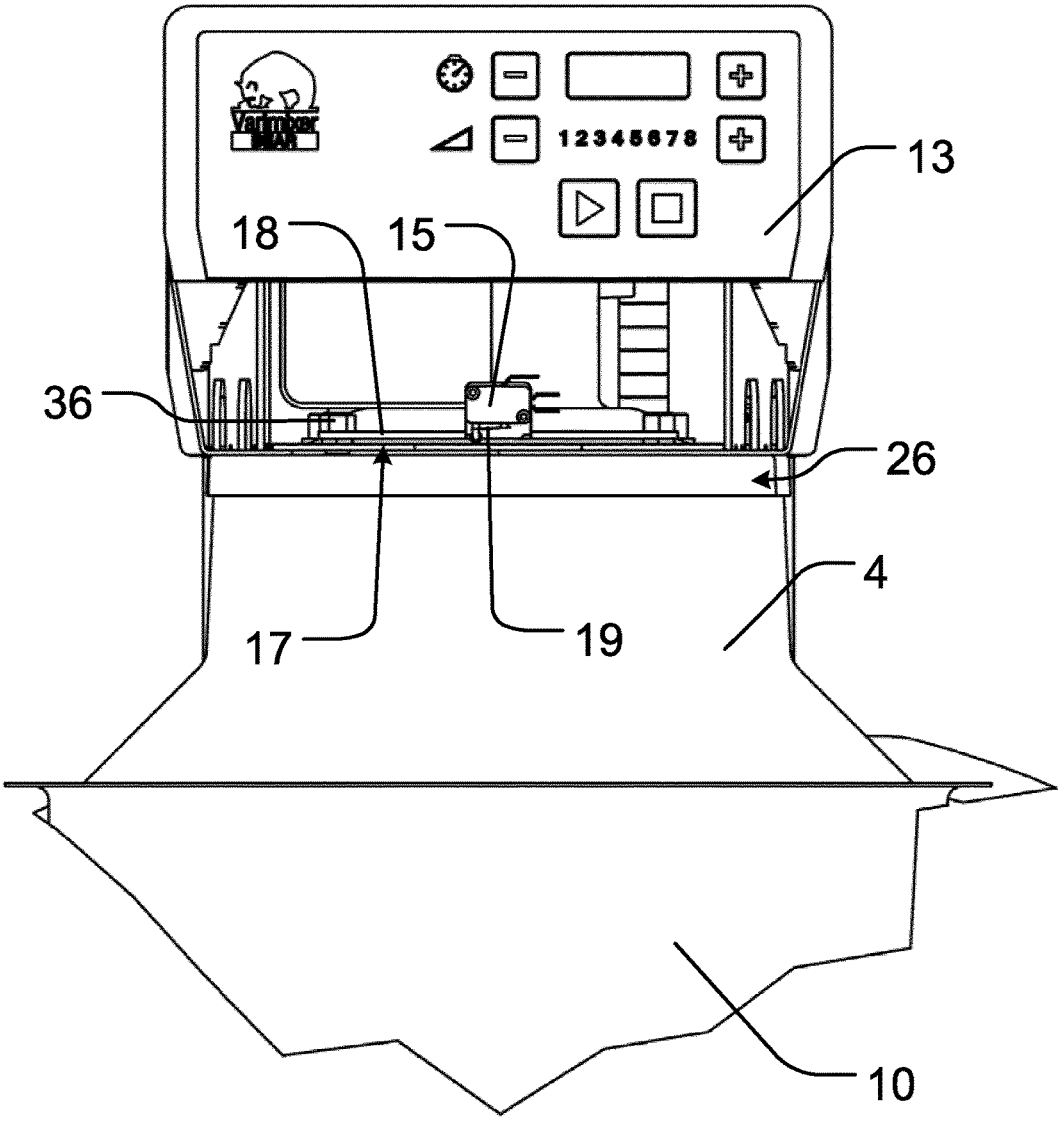
Figure 10:
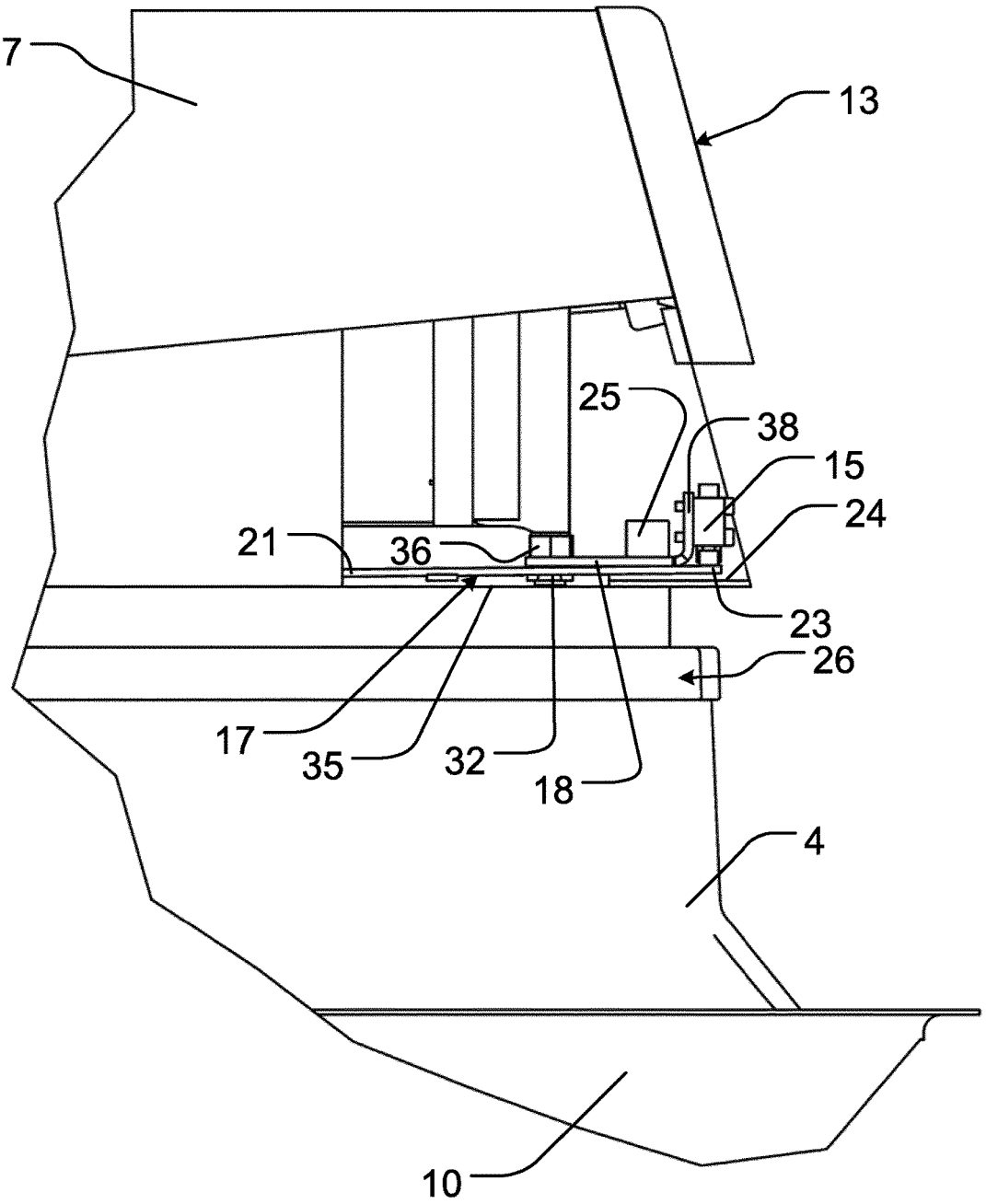
FIGS. 10 and 11 are side views of part of the kneading machine corresponding to the views of FIGS. 8 and 9, respectively.
Figure 11:
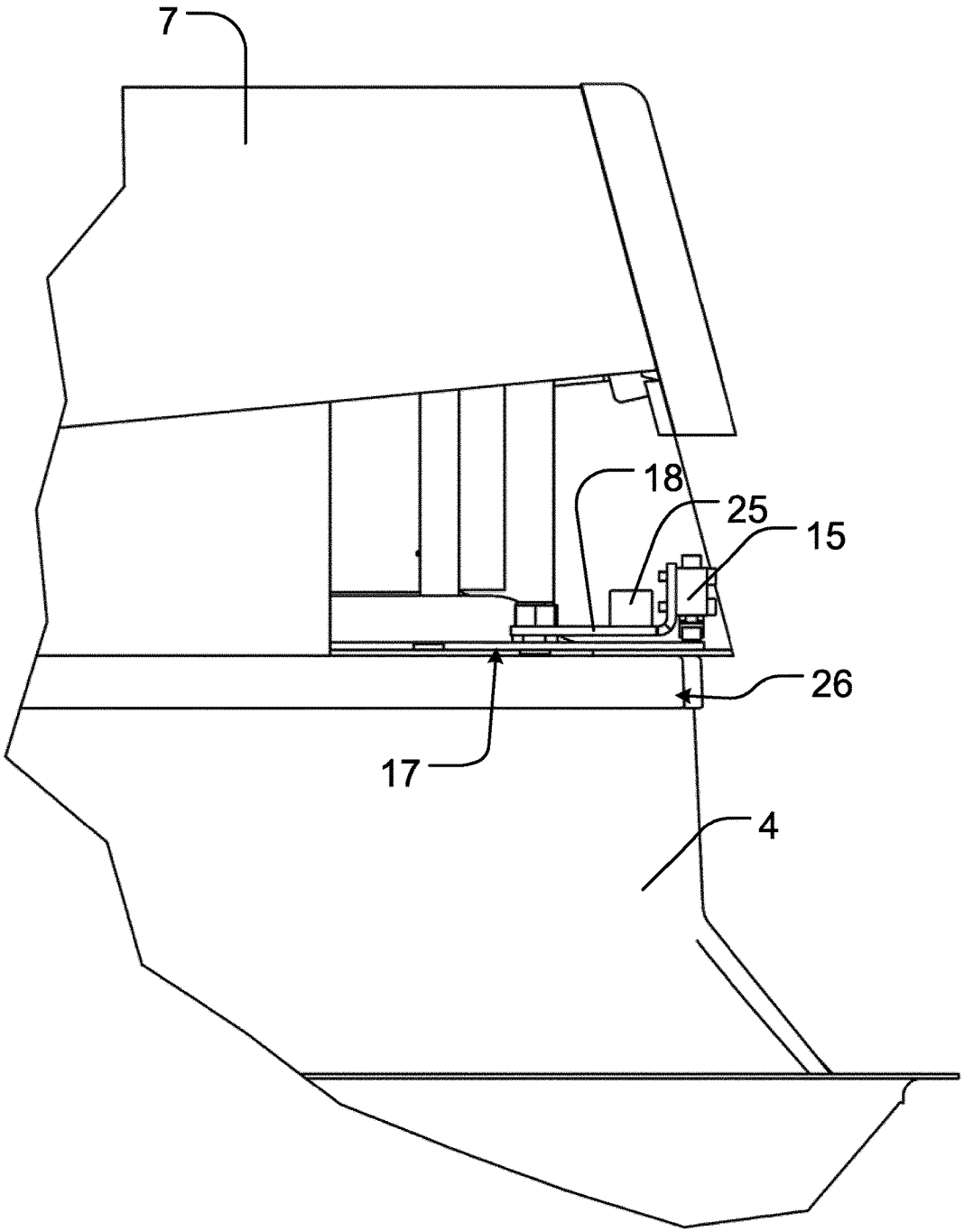
Figure 15:
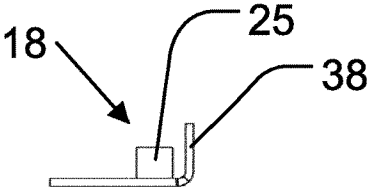
FIG. 15 is a side view of the stationary bracket element in FIG. 13.
Figure 14:
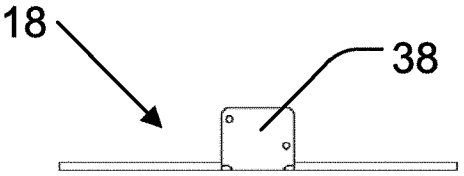
FIG. 14 is a front view of the stationary bracket element in FIG. 13.
Figure 13:
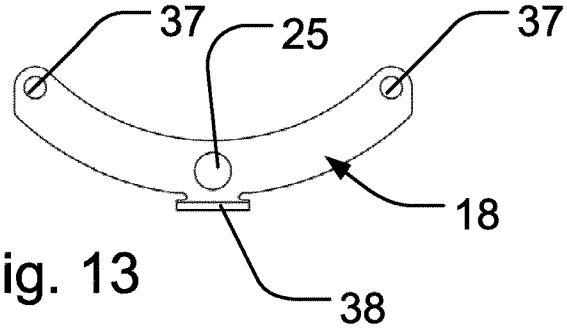
FIG. 13 is a top view of a stationary bracket element of the kneading machine in FIG. 1.
Figure 16:
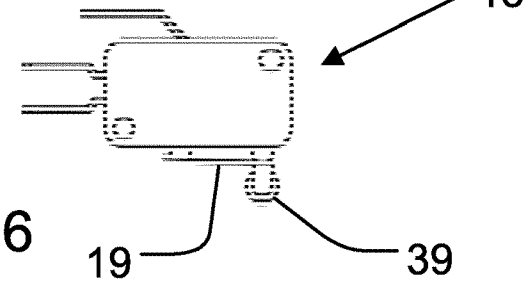
FIG. 16 is a side view of a micro switch of the kneading machine in FIG. 1.

The processing machine 1 furthermore includes a magnetically activatable safety arrangement 14 including a safety switch 15 being operable between a passive state illustrated in FIGS. 6, 9 and 11 in which the motor 2 is allowed to operate and an activated state illustrated in FIGS. 5, 8 and 10 in which the motor 2 is prevented from operation in that the safety switch 15 interrupts the current to the motor. As it is seen in the figures, the safety switch 15 is arranged to switch from its passive state to its activated state when the safety shield 4 is displaced away from its shielding position. A number of magnets 16 are arranged to hold the displaceable safety shield 4 in its shielding position and at the same time hold the safety switch 15 in its passive state as explained in the following.

As illustrated in FIGS. 6 to 11, the magnetically activatable safety arrangement 14 includes a displaceable activation element 17 movable between a first position in which the safety switch 15 is allowed to be in its passive state illustrated in FIGS. 6, 9 and 11 and a second position illustrated in FIGS. 5, 8 and 10 in which the safety switch 15 is forced to its activated state. The displaceable activation element 17 is biased towards its second position, and the magnets 16 are arranged to move the displaceable activation element 17 from its second position to its first position upon displacement of the safety shield 4 into its shielding position as illustrated in FIGS. 6, 9 and 11.

Figure 7:
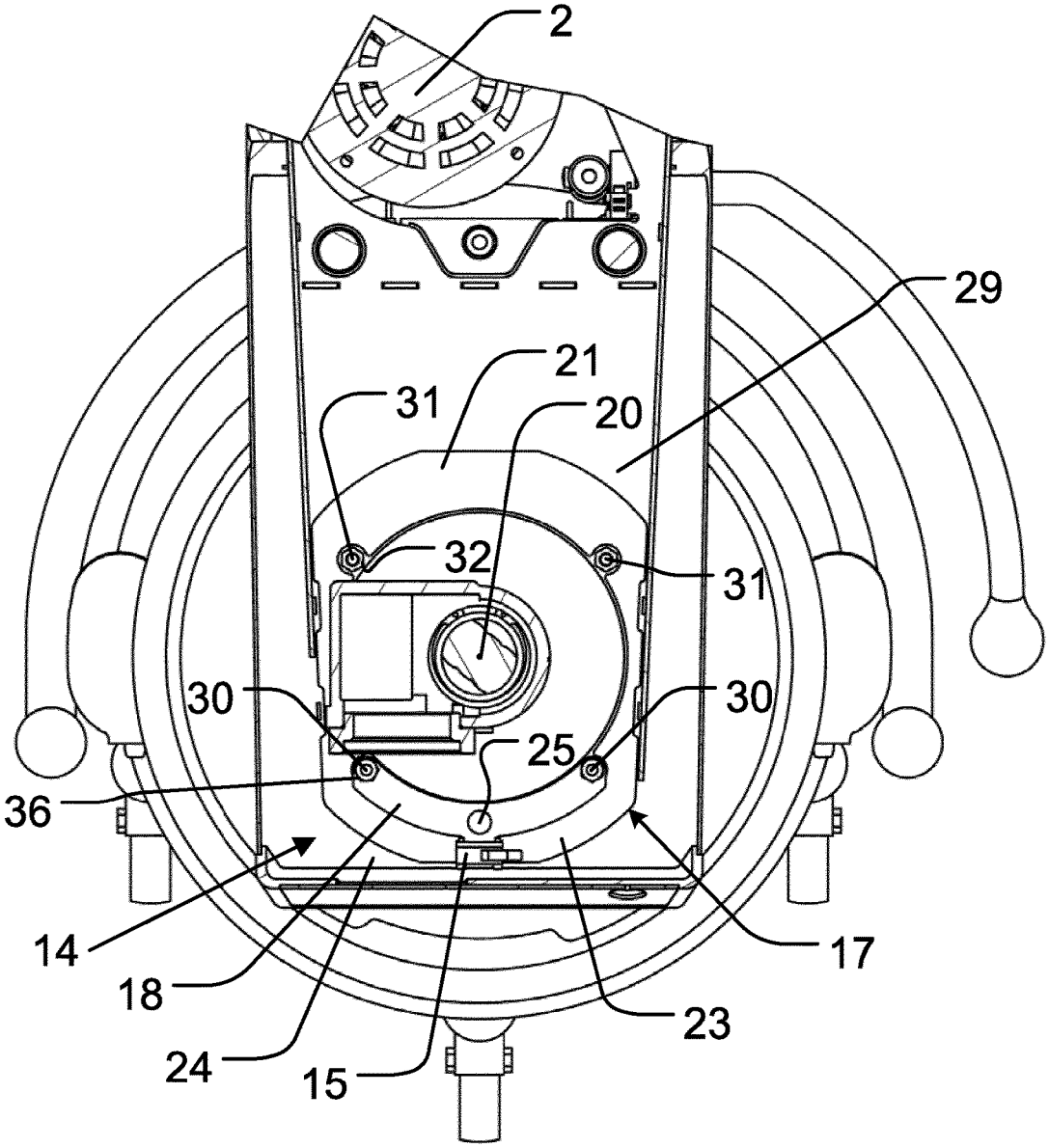
FIG. 7 illustrates part of the cross section in FIG. 4 on a larger scale.
Figure 12:
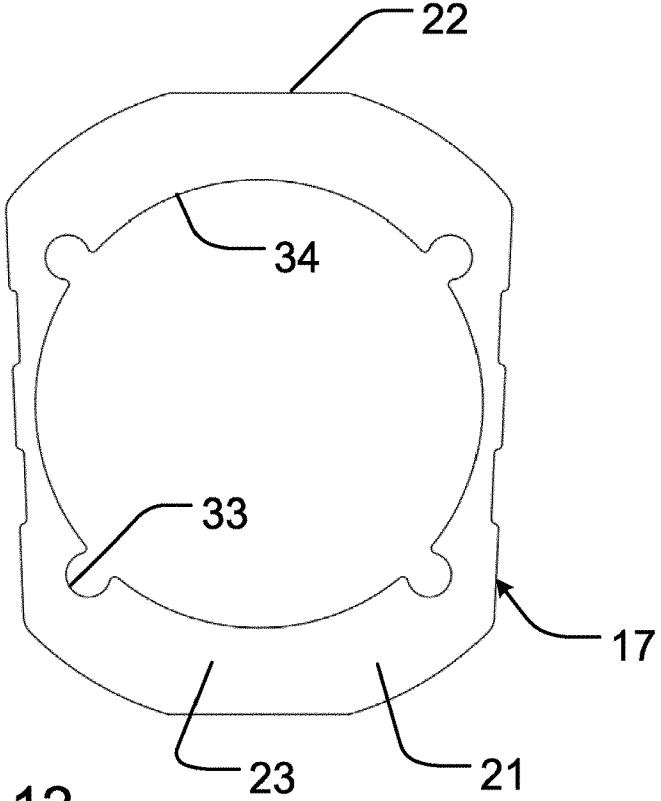
FIG. 12 is a top view of a displaceable ring element of the kneading machine in FIG. 1.
Figure 18:
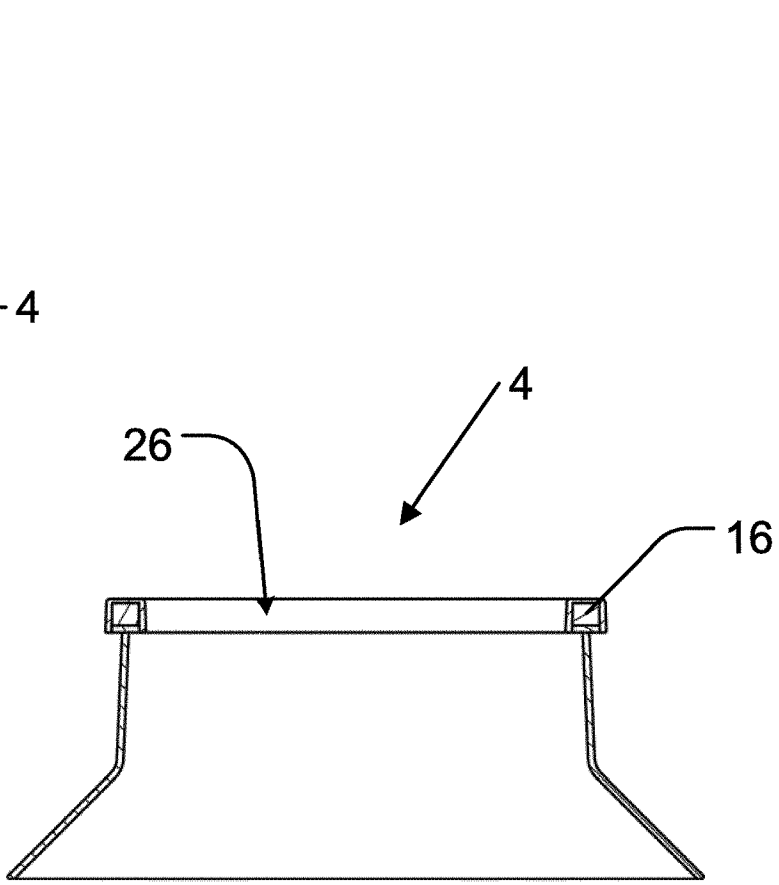
FIG. 18 is an axial cross section through the safety shield in FIG. 17.
Figure 17:
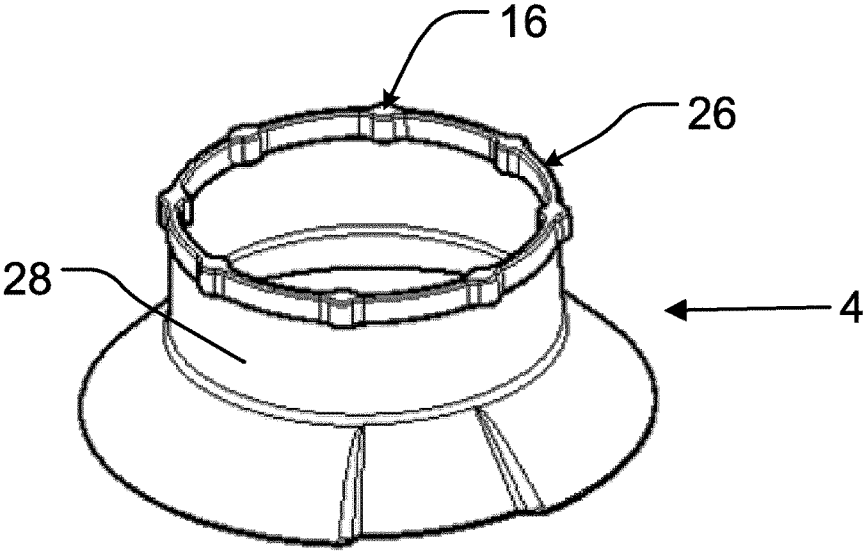
FIG. 17 is a perspective view of a safety shield of the kneading machine in FIG. 1.

In the embodiment illustrated, the displaceable activation element 17 extends in a circumferential direction in relation to a rotational axis 20 of the processing tool in that it has the form of a ring-formed plate element 21 as particularly visible in FIGS. 7 and 12. The ring-formed plate element 21 is arranged tiltably about an edge 22 of the ring-formed plate element so that an activation section 23 of the ring-formed plate element 21 opposed to said edge 22 is movable between a first position illustrated in FIGS. 6, 9 and 11 in which the ring-formed plate element 21 abuts a bottom wall 24 of the horizontally extending housing 7 of the processing machine 1 and a second position illustrated in FIGS. 5, 8 and 10 in which the activation section 23 abuts a stationary bracket element 18 arranged at a distance from the bottom wall 24 of the horizontally extending housing 7.

The ring-formed plate element 21 is arranged tiltably about its edge 22 in that this edge 22 abuts a bottom wall 29 of the horizontally extending housing 7 of the processing machine 1 as illustrated in FIG. 7. The bottom wall 24 and the bottom wall 29 may extend in the same plane or they may be somewhat displaced in relation to each other. For instance, the bottom wall 24 may be formed as a bent in part of a front wall forming the control panel 13, as illustrated in FIG. 6. The bottom wall 29 may be formed by a plate separate there from.

The ring-formed plate element 21 is arranged freely tiltably about its edge 22 but guided by means of four fixed nuts 32 located in cut-outs 33 in an inner edge 34 of the ring-formed plate element 21 as illustrated in FIG. 12. The four nuts 32 are arranged on vertically extending bolts 30, 31 mounted fixedly on a general base 35 of the horizontally extending housing 7 of the processing machine 1.

The ring-formed plate element 21 may be arranged tiltably and guided as required in other any suitable way, for instance by means of a hinge.

The stationary bracket element 18 is arranged between the two front vertically extending bolts 30 on top of the two nuts 32 arranged thereon so that the front vertically extending bolts 30 extend through bores 37 of the stationary bracket element 18. The stationary bracket element 18 is fixed against said two nuts 32 by means of upper nuts 36 arranged on the front vertically extending bolts 30. Alternatively to the bolts 30, the stationary bracket element 18 may be fixed stationarily in the horizontally extending housing 7 in any other suitable way.

The safety switch 15 is arranged on a vertically extending bent up flap 38 of the stationary bracket element 18 so that an activation arm 19 of the safety switch 15 may abut the activation section 23 of the ring-formed plate element 21. The safety switch 15 may be of any suitable type, preferably a conventional micro switch as illustrated in the figures which is adapted to interrupt the current to the motor 2 when the activation arm 19 is pressed in the direction of the housing of the micro switch. The activation arm 19 may be provided with a roller 39 adapted to abut the activation section 23. Preferably this micro switch is so constructed that pressing the arm results in a direct mechanical interruption of the current, so that the risk of failure may be very low.

Furthermore, a permanent magnet 25 is arranged on the stationary bracket element 18 in order to bias the displaceable activation element 17 towards its second position by means of magnetic attraction. The displaceable activation element 17 may be biased towards its second position in any other suitable way, for instance by means of a compression spring arranged between the bottom wall 24 of the horizontally extending housing 7 and the displaceable activation element 17 or by means of a tension spring arranged between the stationary bracket element 18 and the displaceable activation element 17.

The safety shield 4 has a ring-formed contact element 26 adapted to abut a stationary surface 27 of the processing machine 1 extending about the rotational axis 20 of the processing tool. The stationary surface 27 forms the downward face of the general base 35 of the horizontally extending housing 7 of the processing machine 1. The ring-formed contact element 26 is provided with eight magnets 16 spaced regularly in the circumferential direction of the ring-formed contact element 26 and adapted to carry the safety shield 4 in its shielding position so that the safety shield 4 is carried only by means of magnetic force. Any suitable number of magnets 16 may be provided. Indeed, this solution may be very cleaning-friendly compared to known solutions incorporating a mechanically activated micro switch operated through a kind of mechanical labyrinth.

The magnets 16 may be arranged to carry the safety shield 4 by magnetic attraction at least mainly between the magnets 16 and the general base 35 of the horizontally extending housing 7 or at least mainly by magnetic attraction between the magnets 16 and the ring-formed plate element 21 or by a combination of magnetic attraction between the magnets 16 and both the general base 35 and the ring-formed plate element 21. Furthermore, in addition to or instead of the magnets 16, the ring-formed plate element 21 and/or the general base 35 may be provided with a number of permanent magnets for created the required carrying or holding force for the safety shield 4.

As explained above, in the illustrated embodiment, the magnets 16 arranged in the ring-formed contact element 26 are also adapted to attract the displaceable activation element 17. Therefore, the illustrated embodiment whereby the displaceable activation element 17 has the form of the ring-formed plate element 21 may be particularly advantageous in that the safety screen 4 may be placed in any angular position independently of where the magnets 16 are positioned in the ring-formed contact element 26, as long as there are two magnets spaced somewhat apart in the circumferential direction. If the magnets are strong enough, the ring-formed plate element 21 may be tilted about the edge 22 by the magnets 16.

However, the displaceable activation element 17 may have any other suitable form than the ring-form illustrated. For instance, it may simply have the form of a straight bar forming the activation section 23 and arranged displaceably in its transverse direction in any suitable way, such as by means of a spring carrying said bar at either end. Another possibility is a lever arm having a magnetic part at one end and the activation section 23 at another end adapted for activation of the safety switch 15. The magnetic part may be attracted or repulsed by a magnetic element on the safety shield 4. It is noted that in any embodiment, the displaceable activation element 17 may suitably be activated either by means of magnetic attraction or by means of magnetic repulsion.

In the illustrated embodiment, the safety shield 4 has the form of a transparent cover made of acrylic glass or the like. The cover has a tubular at least substantially cylindrical section 28 provided with the ring-formed contact element 26 at its top edge and provided with a tapering at least substantially funnel-shaped section at its bottom edge. However, the safety shield 4 may have any suitable form, such as for instance a safety cover in the form of a screen or grille, possibly adapted to a specific geometry of the processing tool, such as for instance that of a circular saw.

In another not shown embodiment, the safety shield 4 is composed by two parts of which a first part is normally fixed to the cabinet 3 of the processing machine 1 at a rear side of the processing tool seen in relation to a user standing in front of the processing machine 1, and of which a second part is arranged displaceably away from its shielding position either by being mounted detachably by means of magnets as in the embodiment described above or by being mounted tiltably away from its shielding position about a hinge axis so that it may be held in its shielding position by means of at least one magnet. The safety shield 4 may also be composed by only one part arranged tiltably away from its shielding position about a hinge axis whereby it may be held in its shielding position by means of at least one magnet.

It will be understood by the person skilled in the art that the different embodiments described above may be combined in any suitable way.

The invention claimed is:

1. A kneading or mixing machine, including a cabinet and being adapted to carry a kneading or mixing tool, driven by a motor arranged in the cabinet and including a safety shield adapted to at least partly shield the kneading or mixing tool in relation to a user when the safety shield is in a shielding position in relation to the kneading or mixing tool, the safety shield being arranged displaceably away from its shielding position in order to allow access to the kneading or mixing tool, and a magnetically activatable safety arrangement including a safety switch being operable between a passive state in which the motor is allowed to operate and an activated state in which the motor is prevented from operation, said safety switch being arranged to switch from its passive state to its activated state when the safety shield is displaced away from its shielding position, wherein at least one magnet is arranged to hold said displaceable safety shield in its shielding position and at the same time hold the safety switch in its passive state, and wherein said displaceable safety shield is adapted to be carried in its shielding position only by a magnetic force.

2. The kneading or mixing machine according to claim 1, wherein the magnetically activatable safety arrangement includes a displaceable activation element movable between a first position in which the safety switch is allowed to be in its passive state and a second position in which the safety switch is forced to its activated state, wherein the displaceable activation element is biased towards its second position, and wherein the at least one magnet is arranged to move the displaceable activation element from its second position to its first position upon displacement of the safety shield into its shielding position.

3. The kneading or mixing machine according to claim 2, wherein the displaceable activation element extends at least partially in a circumferential direction in relation to a rotational axis of the processing tool.

4. The kneading or mixing machine according to claim 2, wherein the displaceable activation element comprises a ring-formed plate element being arranged tiltably about an edge of the ring-formed plate element so that an activation section of the ring-formed plate element opposed to said edge is movable between a first position and a second position.

5. The kneading or mixing machine according to claim 4, wherein, in the first position of the activation section, the activation section abuts a bottom wall of a housing of the kneading or mixing machine, and in the second position of the activation section, the activation section abuts a stationary bracket element arranged at a distance from the bottom wall of the housing.

6. The kneading or mixing machine according to claim 5, wherein the safety switch is arranged on the stationary bracket element so that an activation arm of the safety switch may abut the activation section of the ring-formed plate element.

7. The kneading or mixing machine according to claim 5, wherein a permanent magnet is arranged on the stationary bracket element in order to bias the displaceable activation element towards its second position.

8. The kneading or mixing machine according to claim 2, wherein the at least one magnet is arranged on the safety shield and is adapted to attract the displaceable activation element.

9. The kneading or mixing machine according to claim 1, wherein the safety shield has a ring-formed contact element adapted to abut a stationary surface of the kneading or mixing machine, said stationary surface extending at least substantially about a rotational axis of the processing tool, and wherein the ring-formed contact element is provided with at least two magnets spaced regularly in a circumferential direction of the ring-formed contact element.

10. A processing machine, including a cabinet and being adapted to carry a processing tool driven by a motor arranged in the cabinet and including a safety shield adapted to at least partly shield the processing tool in relation to a user when the safety shield is in a shielding position in relation to the processing tool, the safety shield being arranged displaceably away from its shielding position in order to allow access to the processing tool, and a magnetically activatable safety arrangement including a safety switch being operable between a passive state in which the motor is allowed to operate and an activated state in which the motor is prevented from operation, said safety switch being arranged to switch from its passive state to its activated state when the safety shield is displaced away from its shielding position, wherein at least one magnet is arranged to hold said displaceable safety shield in its shielding position and at the same time hold the safety switch in its passive state, and wherein said displaceable safety shield is adapted to be carried in its shielding position only by a magnetic force, and wherein the magnetically activatable safety arrangement includes a displaceable activation element wherein the displaceable activation element comprises a ring-formed plate element being arranged tiltably about an edge of the ring-formed plate element so that an activation section of the ring-formed plate element opposed to said edge is movable between a first position and a second position.

11. The processing machine according to claim 10, wherein the displaceable activation element is movable between a first position in which the safety switch is allowed to be in its passive state and a second position in which the safety switch is forced to its activated state, wherein the displaceable activation element is biased towards its second position, and wherein the at least one magnet is arranged to move the displaceable activation element from its second position to its first position upon displacement of the safety shield into its shielding position.

12. The processing machine according to claim 11, wherein the displaceable activation element extends at least partially in a circumferential direction in relation to a rotational axis of the processing tool.

13. The processing machine according to claim 10, wherein, in the first position of the activation section, the activation section abuts a bottom wall of a housing of the processing machine, and in the second position of the activation section, the activation section abuts a stationary bracket element arranged at a distance from the bottom wall of the housing.

14. The processing machine according to claim 13, wherein the safety switch is arranged on the stationary bracket element so that an activation arm of the safety switch may abut the activation section of the ring-formed plate element.

15. The processing machine according to claim 13, wherein a permanent magnet is arranged on the stationary bracket element in order to bias the displaceable activation element towards its second position.

16. The processing machine according to claim 11, wherein the at least one magnet is arranged on the safety shield and is adapted to attract the displaceable activation element.

17. The processing machine according to claim 10, wherein the safety shield has a ring-formed contact element adapted to abut a stationary surface of the processing machine, said stationary surface extending at least substantially about a rotational axis of the processing tool, and wherein the ring-formed contact element is provided with at least two magnets spaced regularly in a circumferential direction of the ring-formed contact element.

18. The processing machine according to claim 10, wherein the processing machine comprises a kneading machine or a mixing machine and wherein the processing tool comprises a kneading tool or a mixing tool.

19. A processing machine including a cabinet and being adapted to carry a processing tool driven by a motor arranged in the cabinet and including a safety shield adapted to at least partly shield the processing tool in relation to a user when the safety shield is in a shielding position in relation to the processing tool, the safety shield being arranged displaceably away from its shielding position in order to allow access to the processing tool, and a magnetically activatable safety arrangement including a safety switch being operable between a passive state in which the motor is allowed to operate and an activated state in which the motor is prevented from operation, said safety switch being arranged to switch from its passive state to its activated state when the safety shield is displaced away from its shielding position, wherein at least one magnet is arranged to hold said displaceable safety shield in its shielding position and at the same time hold the safety switch in its passive state, and wherein said displaceable safety shield is adapted to be carried in its shielding position only by a magnetic force, wherein the safety shield has a ring-formed contact element adapted to abut a stationary surface of the processing machine, said stationary surface extending at least substantially about a rotational axis of the processing tool, and wherein the ring-formed contact element is provided with at least two magnets spaced regularly in a circumferential direction of the ring-formed contact element.

20. The processing machine according to claim 19, wherein the magnetically activatable safety arrangement includes a displaceable activation element movable between a first position in which the safety switch is allowed to be in its passive state and a second position in which the safety switch is forced to its activated state, wherein the displaceable activation element is biased towards its second position, and wherein the at least one magnet is arranged to move the displaceable activation element from its second position to its first position upon displacement of the safety shield into its shielding position.

21. The processing machine according to claim 20, wherein the displaceable activation element extends at least partially in a circumferential direction in relation to a rotational axis of the processing tool.

22. The processing machine according to claim 20, wherein the displaceable activation element comprises a ring-formed plate element being arranged tiltably about an edge of the ring-formed plate element so that an activation section of the ring-formed plate element opposed to said edge is movable between a first position and a second position.

23. The processing machine according to claim 22, wherein, in the first position of the activation section, the activation section abuts a bottom wall of a housing of the processing machine, and in the second position of the activation section, the activation section abuts a stationary bracket element arranged at a distance from the bottom wall of the housing.

24. The processing machine according to claim 23, wherein the safety switch is arranged on the stationary bracket element so that an activation arm of the safety switch may abut the activation section of the ring-formed plate element.

25. The processing machine according to claim 23, wherein a permanent magnet is arranged on the stationary bracket element in order to bias the displaceable activation element towards its second position.

26. The processing machine according to claim 20, wherein the at least one magnet is arranged on the safety shield and is adapted to attract the displaceable activation element.

27. The processing machine according to claim 20, wherein the processing machine comprises a kneading machine or a mixing machine and wherein the processing tool comprises a kneading tool or a mixing tool.

* * * * *